US007051371B2

(12) United States Patent
Tobin et al.

(10) Patent No.: US 7,051,371 B2
(45) Date of Patent: May 30, 2006

(54) SUN MASK TOWEL

(75) Inventors: Joan Mullen Tobin, Arlington Heights, IL (US); Katharine Born McAndrews, Barrington, IL (US)

(73) Assignee: Joan M. Tobin, Arlington Heights, IL (US)

( * ) Notice: Subject to any disclaimer, the term of this patent is extended or adjusted under 35 U.S.C. 154(b) by 264 days.

(21) Appl. No.: 10/636,836

(22) Filed: Aug. 6, 2003

(65) Prior Publication Data

US 2005/0028238 A1 Feb. 10, 2005

(51) Int. Cl.
*A41D 13/00* (2006.01)

(52) U.S. Cl. ..... 2/9; 2/206

(58) Field of Classification Search ..... 2/9, 2/206, 207, 172, 173, 69.5; D2/884, 824; D6/608; 5/417; 297/218.1; 135/902
See application file for complete search history.

(56) References Cited

U.S. PATENT DOCUMENTS

| | | | | |
|---|---|---|---|---|
| 1,911,817 | A | 5/1933 | DuBois | |
| 2,669,717 | A | 2/1954 | Diggs | 2/9 |
| 2,774,970 | A | 12/1956 | DuBois | 2/9 |
| 2,979,170 | A | 4/1961 | Lotz | 190/42 |
| 3,114,914 | A | 12/1963 | Ruggiero | 2/8 |
| 3,295,143 | A | 1/1967 | Hoffman | 2/12 |
| 3,346,875 | A | 10/1967 | Weisberger | 2/9 |
| 3,651,847 | A | 3/1972 | Casamassima | 150/28 |
| 3,686,690 | A | 8/1972 | Webb | 2/9 |
| 4,259,748 | A * | 4/1981 | Miller | 2/206 |
| 4,364,123 | A | 12/1982 | Sam | 2/209.1 |
| 4,856,109 | A | 8/1989 | Desy et al. | 2/9 |
| 5,062,157 | A | 11/1991 | Muta | 2/171 |
| 5,617,584 | A * | 4/1997 | Brennan | 2/206 |
| 5,619,749 | A | 4/1997 | Banuchi | 2/9 |
| 5,634,210 | A | 6/1997 | King et al. | 2/9 |
| 5,682,606 | A | 11/1997 | Pospisil | 2/9 |
| 5,832,538 | A | 11/1998 | Williams | 2/202 |
| 5,845,340 | A * | 12/1998 | Frislie | 2/202 |
| D465,317 | S * | 11/2002 | Darling | D2/824 |

* cited by examiner

*Primary Examiner*—Katherine M. Moran
(74) *Attorney, Agent, or Firm*—McAndrews, Held & Malloy

(57) ABSTRACT

A sun mask towel is provided, made from a planar section of fabric for blocking or reflecting the ultraviolet rays of the sun. By including eye, nose, and mouth slits, the sun mask towel allows users see, speak, and breathe easily. The sun mask towel effectively shields a user's face, head, neck, and in one embodiment, a user's entire body from the harmful rays of the sun. Further, the sun mask towel is easy to use and easy to carry.

11 Claims, 3 Drawing Sheets

SUN MASK TOWEL

CROSS-REFERENCE TO RELATED APPLICATIONS

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Certain embodiments of the present invention relate generally to the field of skin protection from harmful ultraviolet rays of the sun. More specifically, certain embodiments of the present invention relate to the use of a sun mask towel for protecting a user's skin from overexposure to the sun by blocking or reflecting the sun's ultraviolet rays.

Although the public is generally aware of the existence of ultraviolet (UV) rays, many people do not understand what UV rays are and what serious adverse health effects UV rays may cause. UV rays are simply light waves that are invisible but carry more energy than visible light. There are three types of UV rays—UVA, UVB, and UVC. Over-exposure to solar ultraviolet radiation can cause sunburn, skin damage, premature aging of the skin, and an increased risk of developing skin cancer. In an attempt to protect people from harmful UV rays, many lotions, hats, headbands, masks, helmets, and other devices have been designed to aid in shielding harmful UV rays.

However, the prior art intended to protect a user's skin from harmful UV rays commonly leaves a lotion residue on the user's skin (e.g. sun tan lotion); does not allow a user to see, breathe, or speak easily (e.g. some of the available masks or helmets); only partially covers the skin a user wishes to protect (e.g. hats, visors, and headbands); or is bulky, cumbersome, difficult to use, or difficult to carry (e.g. some of the available masks or helmets). There is a need in the art for an easy to use, easy to carry form of sun protection which blocks harmful UV rays to the entire area of skin a user wishes to protect, while allowing a user to see, talk, and breathe easily.

BRIEF SUMMARY OF THE INVENTION

In accordance with one embodiment, a sun mask towel is provided that includes a planar section or sheet of fabric, such as pile towel fabric, for blocking or reflecting the ultraviolet rays of the sun. The fabric includes either at least one eye slit, at least one nose slit, at least one mouth slit, or any combination of those. In one embodiment, the user is provided separate eye slits. In another embodiment, a single larger eye slit in the fabric is provided. Similarly, in one embodiment, separate nose slits are provided, while in another embodiment of the invention, one larger nose slit is provided. The one or combination of eye, nose, and mouth slits can be elliptical, circular, or rectangular in nature and positioned in a manner on the planar section of fabric as to correspond with a user's eyes, nose and mouth, while still covering the remainder of a user's face, ears, neck, top of head, and in one embodiment, the remainder of the user's body.

The sun mask towel is used by laying the fabric over the user's face, neck, and in one embodiment of the invention, the user's entire body while lying down or in a reclined position. The user then adjusts the fabric so that the eye, nose, and mouth slits line up with the user's eyes, nose, and mouth. The sun mask towel will then be covering the top of the user's head, the user's face, ears, neck, and in one embodiment, the user's entire body. Furthermore, the eye, nose, and mouth slits will allow the user to see, speak, and breath easily while wearing the sun mask towel. The towel can also be used as a conventional beach towel, to lie on or to dry one's skin after swimming.

BRIEF DESCRIPTION OF SEVERAL VIEWS OF THE DRAWINGS

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 1:
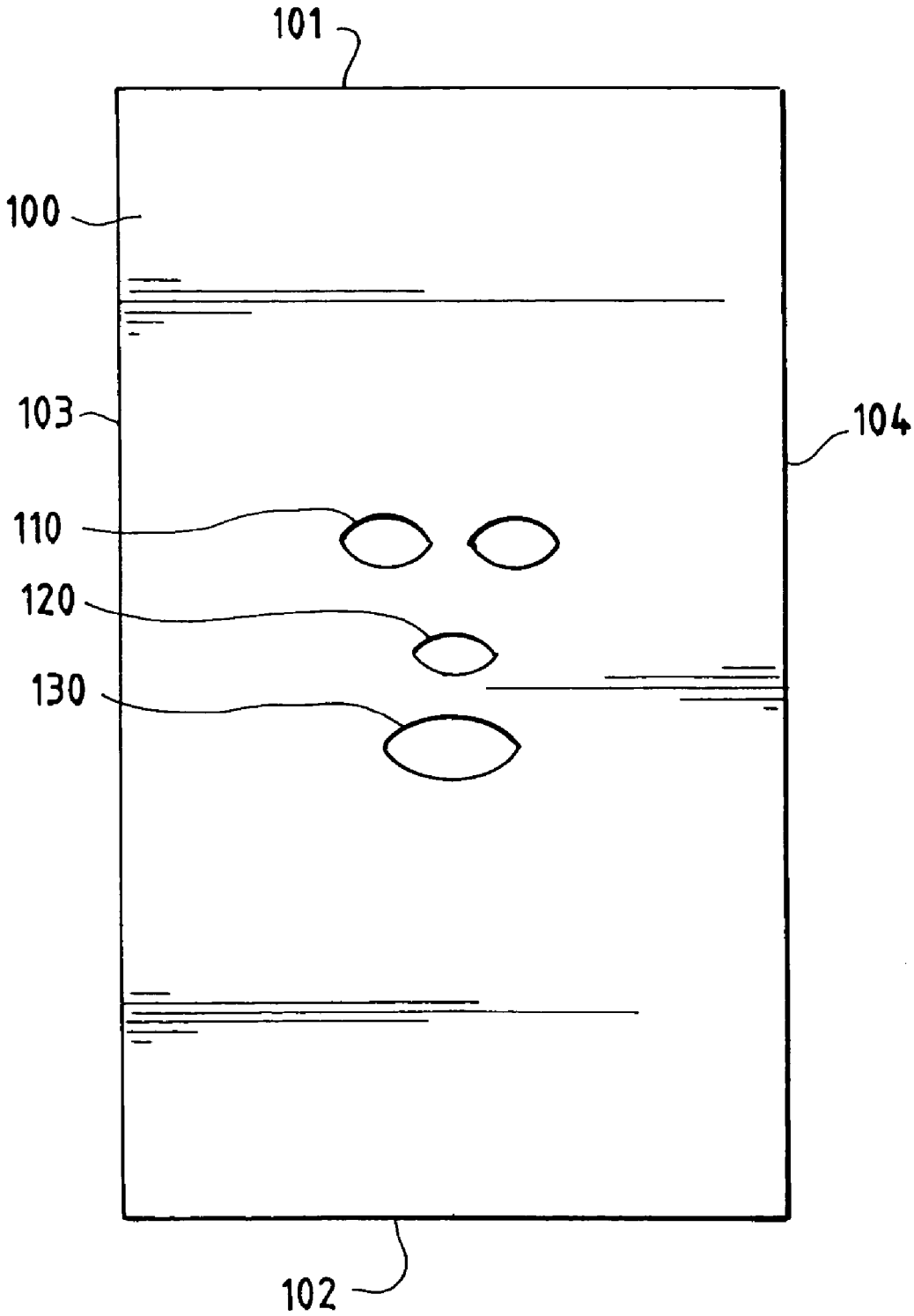
FIG. 1 illustrates a sun mask towel for use in protecting the head, face and neck of a user.

FIG. 1 illustrates an exemplary embodiment of the sun mask towel 100 for use in protecting a user's head, face, and neck. The fabric is a pile fabric, for example, a loop pile fabric or a cut pile fabric. The one or multiple nose slits 120 typically are positioned in the center of the fabric between opposing end edges 101 and 102 and between opposing side edges 103–104. By centering the nose slits 120, enough fabric remains above the nose slits 120 to cover the top of a user's head, enough fabric remains below the nose slits 120 to cover a user's neck, and enough fabric remains on both sides of the nose slits 120 to cover both of a user's ears. The nose slits 120 can alternatively be placed off-center, and can be oriented in any direction. The nose slit 120 may be one circular, elliptical, rectangular, or otherwise shaped slit or flap or opening large enough so that the fabric will not block a user's nostrils. However, the nose slit 120 preferably is not so large as to fail to effectively cover a user's nose. In this embodiment, the nose slit 120 is large enough for easy breathing for a user while covering as much of a user's skin as possible. Further, there may be multiple nose slits 120 which are circular or elliptical or otherwise shaped and align with a user's nostrils. Multiple nose slits 120 may allow for maximum skin protection while maintaining adequate breathability. To prevent fraying of the fabric material, the nose slit 120 may include stitching on the inner edge of the slit.

In this embodiment, the one or multiple eye slits 110 are centered between the opposing side edges 103–104 and positioned about two inches above the nose slit 120. The eye slits 110 and breathing slit (such as nose slit 120) are non-contiguous openings separated by a web of said fabric. Like the nose slit or slits, different shapes, other orientations, and off-center positioning are also contemplated. The exact distance between the eye slits 110 and the nose slit 120 may vary for different users, but on average, the eye slits 110 should be approximately two inches above the nose slit 120. The eye slits 110 may be two circular, elliptical, rectangular, or otherwise shaped slits large enough to allow a user to see easily. However, the eye slits 110 preferably are small enough that the fabric effectively covers a user's forehead, cheeks, and temples. In an embodiment where multiple eye slits 110 are used, the inner edges of the eye slits 110 are approximately one inch from each other. The exact distance between the eye slits 110 may vary for different users. To prevent fraying of the fabric material, the eye slits 110 may include stitching on the inner edge of each slit.

Figure 3:
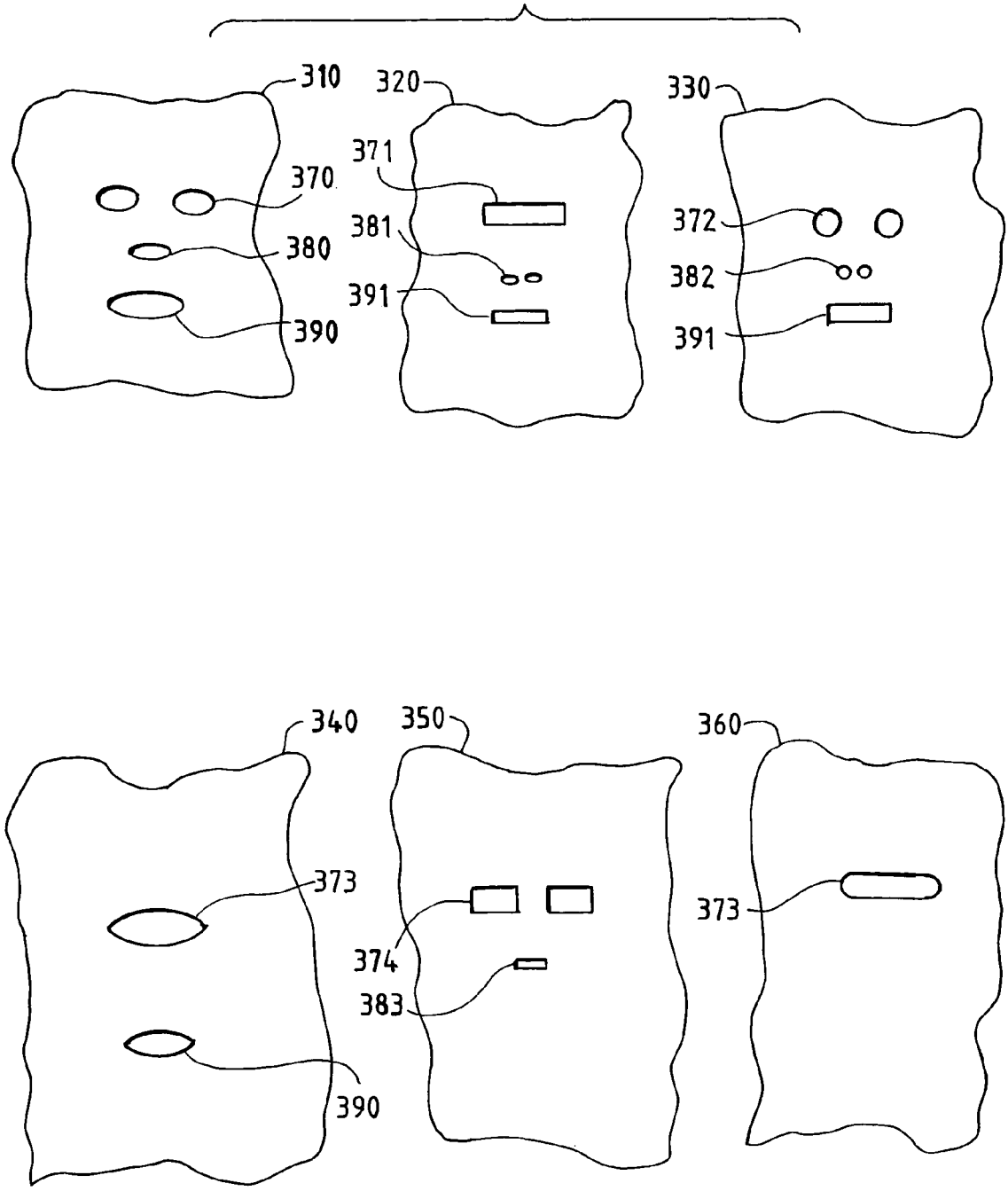
FIG. 3 illustrates alternative embodiments for the style and configuration of the eye, nose and mouth slits.

In another embodiment, a single larger eye slit 373 is provided in the pile towel fabric (See FIG. 3). The single eye slit 373 is centered between the opposing side edges 103–104 and positioned a couple inches above the nose slit 120. The exact distance between the single eye slit 373 and the nose slit 120 may vary for different users, but on average, the single eye slit 373 should be approximately two inches above the nose slit 120. The single eye slit 373 may be an elliptical or rectangular slit large enough to allow a user to effectively see through while covering as much of a user's skin surrounding the eyes as possible. To prevent fraying of the fabric material, the single eye slit 373 may include stitching on the inner edge of the slit.

In one embodiment, the eye slits of the towel 100 can be sized and shaped to accommodate a user wearing sunglasses that protect the eyes and surrounding skin.

The mouth slit 130 is centered between the opposing side edges 103–104 and positioned approximately one inch below the nose slit 120. The exact distance between the mouth slit 130 and the nose slit 120 may vary for different users, but on average, the mouth slit 130 should be approximately one inch below the nose slit 120. The mouth slit 130 may be a circular elliptical, rectangular, or otherwise shaped slit large enough to allow a user to speak easily. However, the mouth slit 130 preferably is not so large so as to expose more of a user's cheeks and chin than necessary. To prevent fraying of the fabric material, the mouth slit 130 may include stitching on the inner edge of the slit.

The distance between the opposing end edges 101 and 102 (i.e. length) of the fabric should be at least twenty-five inches to effectively cover both the top of a user's head and the user's neck. It may be necessary to increase the length of the fabric for different size users. The distance between the opposing side edges 103–104 (i.e. width) of the fabric can be fifteen inches or longer to effectively cover the ears and side of a user's head and neck. It may be necessary to increase the width of the fabric for different users. The thickness of the fabric may vary with the type of fabric used for constructing the sun mask towel. For the comfort of a user, the fabric chosen can be fairly thin (i.e. a quarter of an inch or less) to help prevent a user from overheating. However, the embodiment is not intended to be limited to the foregoing dimensions. Rather, the foregoing dimensions serve as a guide to one skilled in the art as to appropriate dimensions for a sun mask towel.

Figure 2:
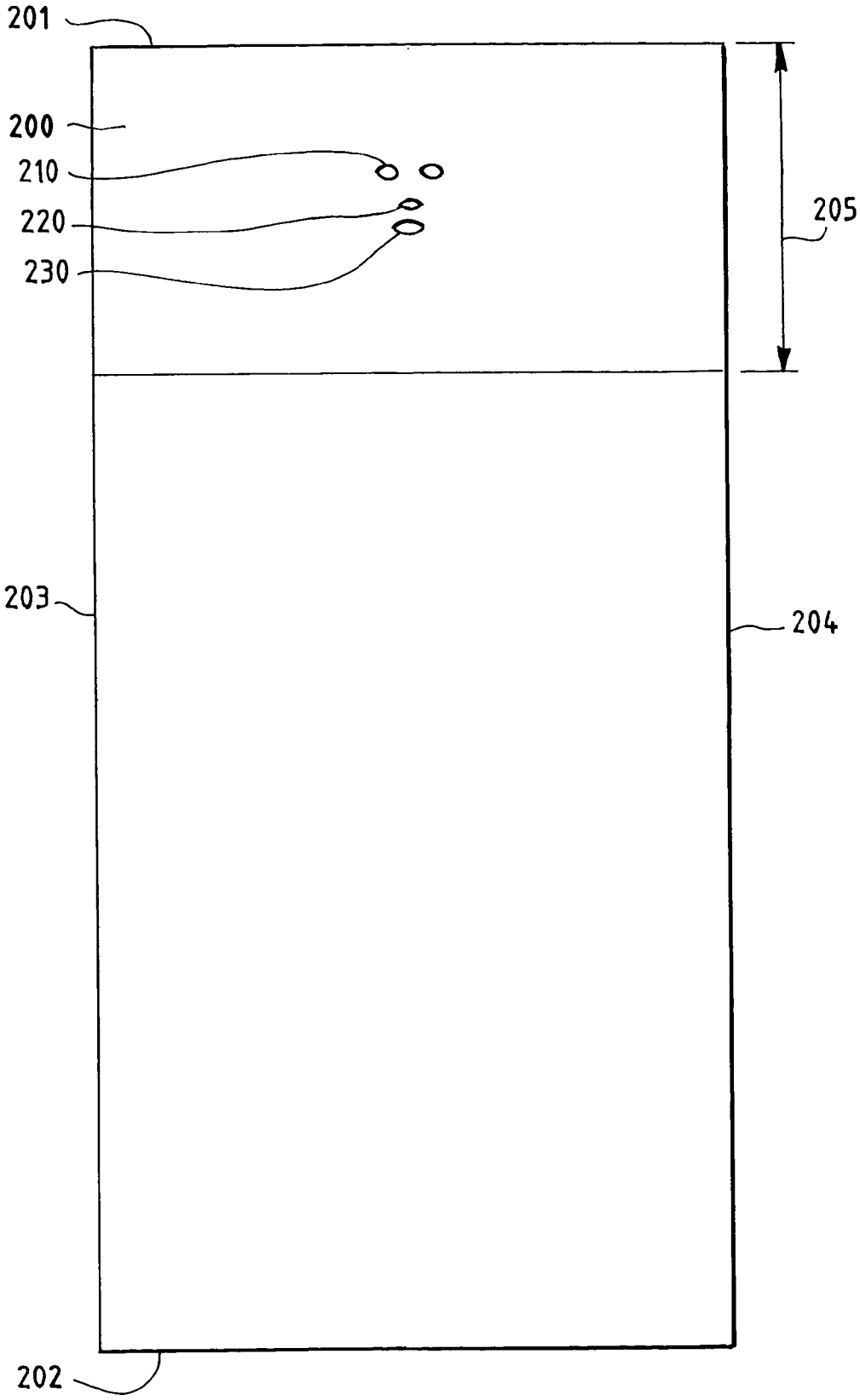
FIG. 2 illustrates a sun mask towel for use in protecting the entire body of a user.

FIG. 2 illustrates an exemplary embodiment of the sun mask towel 200 for use in protecting a user's entire body. In this embodiment, the one or multiple nose slits 220 are positioned in the center of the top quarter 205 of the fabric material, closest to the top edge 201. Furthermore, the one or multiple nose slits 220 are centered between the opposing side edges 203–204. By centering the nose slits 220 in the top quarter 205 of the fabric material, enough fabric remains above the nose slits 220 to cover the top of a user's head and the fabric remains long enough to cover most, if not all, of the remainder of the user's body. Further, by centering the nose slits 220 between the opposing side edges 203–204, the fabric remains wide enough on both sides to cover a user's ears, shoulders, arms, hips, and legs.

The one or multiple eye slits 210 are centered between the opposing side edges 203–204 and positioned a couple inches above the nose slit 220, in this embodiment. The exact distance between the eye slits 210 and the nose slit 220 may vary for different users, but on average, the eye slits 210 should be approximately two inches above the nose slit 220. The eye slits 210 may be two circular, elliptical, or rectangular slits large enough to effectively see through while covering as much of a user's skin surrounding the eyes as possible. In an embodiment where multiple eye slits 210 are used, the inner edges of the eye slits 210 should be approximately one inch from each other. The exact distance between the eye slits 210 may vary for different users.

In another embodiment, a single larger eye slit 373 is provided in the fabric (See FIG. 3). The single eye slit 373 is centered between the opposing side edges 203–204 and positioned a couple inches above the nose slit 220. The exact distance between the single eye slit 373 and the nose slit 220 may vary for different users, but on average, the single eye slit 373 is approximately two inches above the nose slit 220. The single eye slit 373 may be an elliptical, rectangular, or otherwise shaped or oriented slit, large enough to allow a user to effectively see through while covering as much of a user's skin surrounding the eyes as possible. To prevent fraying of the fabric material, the single eye slit 373 may include stitching on the inner edge of the slit.

The mouth slit 230 is centered between the opposing side edges 203–204 and positioned approximately one inch below the nose slit 220. The exact distance between the mouth slit 230 and the nose slit 220 may vary for different users, but on average, the mouth slit 230 can be approximately one inch below the nose slit 220. The mouth slit 230 may be a circular, elliptical, or rectangular slit, large enough to effectively speak through while covering as much of a user's skin surrounding the mouth as possible. To prevent fraying of the fabric material, the mouth slit 230 may include stitching on the inner edge of the slit.

In one embodiment, the distance between the opposing top 201 and bottom 202 edges (i.e. length) of the fabric is at least sixty inches to effectively cover both the top of a user's head and the user's neck. It may be necessary to increase the length of the fabric for different sized users. The distance between the opposing side edges 203–204 (i.e. width) of the fabric is at least thirty inches to effectively cover the ears and side of a user's head and neck. It may be necessary or desirable for the width of the fabric to change for different sized users. The thickness of the fabric may vary with the type of fabric used for constructing the sun mask towel.

FIG. 3 illustrates alternative embodiments for the style and configuration of the eye, nose, and mouth slits. In one embodiment, the fabric (310, 320, and 330) includes eye 370–372, nose 380–382, and mouth slits 390–391. In another embodiment, the fabric 340 includes an eye slit 373 and a mouth slit 390. In yet another embodiment, the fabric 350 includes eye slits 374 and a nose slit 383. In one embodiment, the fabric 360 includes only an eye slit 373.

FIG. 3, four exemplary eye slit styles, four exemplary nose slit styles, and two exemplary mouth slit styles are shown. In alternative embodiments, two eye slits (370, 372, and 374) or one larger eye slit (371 and 373) may be used. Further, the one or more eye slits may be elliptical (370 and 373), rectangular (371 and 374), or circular 372. In alternative embodiments, two nose slits (381–382) may be used or one larger nose slit (380 and 383). Further, the one or more nose slits may be elliptical (380–381), circular 382, or rectangular 383. In alternative embodiments, the mouth slit may be elliptical 390 or rectangular 391. The foregoing is not intended to limit the style or configuration of the eye, nose, and mouth slits. Several other slit styles and configurations will allow a user to function normally while effectively blocking the harmful UV rays of the sun.

The preferred fabric of the embodiment is pile towel fabric, which is very absorbent and useful for drying off, like a conventional towel. However, any fabric which prevents UV rays from reaching a user's covered skin can be used alternatively. Fabric best suited for use as a sun mask towel includes fabric which is breathable, light weight and soft.

In one embodiment, the preferred color of the fabric is white, light colored, or any color which reflects the sun's rays as well as absorbing the rays. However, the embodiment is not intended to be limited to a specific color or arrangement of colors or mode of action. Any fabric of any color is adequate to reflect or block UV rays. The use of lighter colored fabric offers the additional advantage of reflecting the sun's rays to a greater degree, which allows the fabric to stay cooler for the comfort of a user.

The sun mask towel is used by laying the fabric over the user's face, neck, and in one embodiment of the invention, the user's entire body while lying down or in a reclined or sitting position. The user then adjusts the fabric so that the eye, nose, and mouth slits line up with the user's eyes, nose, and mouth. The sun mask towel will then be covering the top of the user's face, ears, neck, and in one embodiment, the user's entire body. Furthermore, the eye, nose and mouth slits will allow the user to see, speak, and breath easily while wearing the sun mask towel.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A fabric towel mask for blocking or reflecting the ultraviolet rays of the sun, comprising:

a beach towel made of a generally rectangular, single sheet of pile towel material having opposing end edges, opposing side edges, and top and bottom surfaces, wherein the width of said material is at least fifteen inches between opposing side edges;

said towel having at least one eye slit permitting unobstructed vision through said towel and at least one breathing slit providing unobstructed breathing through said towel, said eye slit and breathing slit being relatively positioned on said sheet to respectively register with the eyes and at least one breathing opening of a user when the sheet is draped over a user's face, the breathing opening being the nostrils or the mouth of the user;

said eye slit and breathing slit being non-contiguous openings separated by a web of said fabric.

2. The fabric towel mask of claim 1 wherein the length of said material is at least twenty-five inches between opposing end edges.

3. The fabric towel mask of claim 1 wherein the width of said material is at least thirty inches between opposing side edges.

4. The fabric towel mask of claim 3 wherein the length of said material is at least sixty inches between opposing end edges.

5. The towel mask of claim 1 wherein the at least one eye slit and the at least one breathing slit are elliptical or circular shaped.

6. The fabric towel mask of claim 1 wherein the edges of the at least one eye slit and at least one breathing slit are stitched to prevent fraying of the fabric material.

7. The fabric towel mask of claim 1, wherein said breathing slit is relatively positioned on said sheet to register with the nostrils of the user.

8. The fabric towel mask of claim 1, wherein said breathing slit is relatively positioned on said sheet to register with the mouth of the user.

9. The fabric towel mask of claim 1, further comprising a nose slit relatively positioned on said sheet to register with the nostrils of the user, wherein said breathing slit is relatively positioned on said sheet to register with the mouth of the user.

10. The fabric towel mask of claim 1, wherein the at least one eye slit comprises first and second eye slits relatively positioned on said sheet to register with both eyes of the user.

11. The fabric towel mask of claim 1, having no fasteners.

* * * * *